US009404191B2

(12) United States Patent
Hara et al.

(10) Patent No.: US 9,404,191 B2
(45) Date of Patent: Aug. 2, 2016

(54) ANODE FOR USE IN ZERO-GAP BRINE ELECTROLYZER, BRINE ELECTROLYZER AND METHOD FOR ZERO-GAP BRINE ELECTROLYSIS EMPLOYING SAME

(71) Applicant: DAISO CO., LTD., Osaka-shi (JP)

(72) Inventors: Kanefusa Hara, Osaka (JP); Satoshi Hatano, Osaka (JP)

(73) Assignee: OSAKA SODA CO., LTD., Osaka-shi (JP)

( * ) Notice: Subject to any disclaimer, the term of this patent is extended or adjusted under 35 U.S.C. 154(b) by 0 days.

(21) Appl. No.: 14/439,653

(22) PCT Filed: Oct. 25, 2013

(86) PCT No.: PCT/JP2013/078956

§ 371 (c)(1),
(2) Date: Apr. 29, 2015

(87) PCT Pub. No.: WO2014/069360

PCT Pub. Date: May 8, 2014

(65) Prior Publication Data

US 2015/0299876 A1 Oct. 22, 2015

(30) Foreign Application Priority Data

Oct. 31, 2012 (JP) ..... 2012-240222

(51) Int. Cl.
*C25B 11/03* (2006.01)
*C25B 1/46* (2006.01)
(Continued)

(52) U.S. Cl.
CPC . *C25B 11/03* (2013.01); *C25B 1/46* (2013.01); *C25B 9/08* (2013.01); *C25B 9/10* (2013.01); *C25B 11/035* (2013.01)

(58) Field of Classification Search
CPC ..... C25B 1/34; C25B 1/46; C25B 11/0473; C25B 11/0494; C25B 9/08; C25B 9/10; C25B 11/03; C25B 11/035
See application file for complete search history.

(56) References Cited

U.S. PATENT DOCUMENTS 4,340,452 A * 7/1982 deNora ..... C25B 1/46 204/263
4,560,461 A * 12/1985 Okazaki ..... C25B 9/08 204/252

(Continued)

FOREIGN PATENT DOCUMENTS

JP 49-013099 A 2/1974
JP 09-239364 A 9/1997

(Continued)

*Primary Examiner* — Steven A. Friday
(74) *Attorney, Agent, or Firm* — Knobbe Martens Olson & Bear LLP

(57) ABSTRACT

It is an object of the present invention to provide an anode for a zero-gap brine electrolyzer which through employment of a highly roughened surface at a catalyst layer at an anode for a zero-gap brine electrolyzer makes it possible to achieve sufficient liquid permeability and further reduction in electrolyzing voltage and a brine electrolysis method employing same. The present invention relates to an anode for a zero-gap brine electrolyzer equipped with a liquid-permeable conductive substrate 21, and with a catalyst layer 22 which is provided on the conductive substrate 21 and which is such that the maximum difference in height of surface irregularities is 55 μm to 70 μm; a zero-gap brine electrolyzer equipped with the anode 20, a cathode 30, and an ion-exchange membrane I disposed between and in contact with the anode 20 and the cathode 30; and a brine electrolysis method employing same.

7 Claims, 5 Drawing Sheets

(51) Int. Cl.
*C25B 9/08* (2006.01)
*C25B 9/10* (2006.01)

(56) References Cited

U.S. PATENT DOCUMENTS 5,167,788 A 12/1992 Hardee et al.
5,262,040 A 11/1993 Hardee et al.
5,314,601 A 5/1994 Hardee et al.
5,324,407 A 6/1994 Ernes et al.
2001/0052468 A1 12/2001 Jacobo et al.
2006/0042935 A1 3/2006 Houda et al.

FOREIGN PATENT DOCUMENTS

JP 2721739 B2 11/1997
JP 2001-262387 A 9/2001
JP 2002-030495 A 1/2002
JP 4453973 B2 2/2010

* cited by examiner

ANODE FOR USE IN ZERO-GAP BRINE ELECTROLYZER, BRINE ELECTROLYZER AND METHOD FOR ZERO-GAP BRINE ELECTROLYSIS EMPLOYING SAME

CROSS-REFERENCE TO RELATED APPLICATIONS

This application is the U.S. National Phase under 35. U.S.C. §371 of International Application PCT/JP2013/078956, filed Oct. 25, 2013, which claims priority to Japanese Patent Application No. 2012-240222, filed Oct. 31, 2012. The disclosures of the above-described applications are hereby incorporated by reference in their entirety.

TECHNICAL FIELD

The invention relates to an anode for use in zero-gap brine electrolyzers, a zero-gap brine electrolyzer, and a brine electrolysis method therewith.

BACKGROUND ART

There are known conventional electrodes for use in electrolysis that include a conductive substrate and a catalyst layer with which the conductive substrate is coated. Known methods for manufacturing such electrodes for electrolysis include subjecting a conductive substrate to sand blasting or acid etching for surface roughening so that a catalyst layer can be deposited with improved adhesion onto the surface of the conductive substrate; and then forming a catalyst layer on the roughened surface of the conductive substrate (see, for example, Patent Documents 1 and 2).

An aqueous solution of an alkali metal salt, specifically, an aqueous solution of sodium chloride is electrolyzed to produce chlorine, hydrogen, and sodium hydroxide. It is well known that this process is performed using a brine electrolyzer for ion-exchange membrane process, which includes an anode chamber and a cathode chamber separated by a cation-exchange membrane and is configured to allow a current to flow between an anode in the anode chamber and a cathode in the cathode chamber so that electrolysis is performed. There have been various modifications of this type of electrolyzer. For example, dimensionally stable electrodes are developed as anodes, and active cathodes with low hydrogen overpotential are developed as cathodes, so that electrolytic voltage for brine electrolysis using ion-exchange membrane process is reduced. Particularly, recent improvements in electrolysis technology are remarkable. One of such improvements is a zero-gap brine electrolyzer having an anode and a cathode both in tight contact with a cation-exchange membrane, which is developed to further reduce electrolytic voltage (see, for example, Patent Documents 3 and 4).

In brine electrolyzers for ion-exchange membrane process, the anode is inherently in tight contact with the ion-exchange membrane. In zero-gap brine electrolyzers, the cathode is additionally brought into tight contact with the ion-exchange membrane. The ion-exchange membrane is naturally pressed against and brought into tight contact with the anode because the liquid pressure is higher on the cathode side than on the anode side so that the electrolyte pressure differs between the anode-side and cathode-side of the ion-exchange membrane. In addition to this state, zero-gap brine electrolyzers are designed in such a way that the cathode is intentionally and physically brought into tight contact with the ion-exchange membrane so that the electric resistance between the ion-exchange membrane and the cathode can be reduced and thus the electrolytic voltage can be reduced. In such zero-gap brine electrolyzers, the pressure at which the ion-exchange membrane is pressed against the anode increases as the cathode is brought into tight contact with the ion-exchange membrane.

To address the increase in the pressing pressure, the zero-gap brine electrolyzer described in Patent Document 4 is designed in such a way that its anode has a rigid structure with rigidity high enough to be less deformable even when pressed against an ion-exchange membrane, while its cathode has a flexible structure that can maintain the zero-gap by absorbing irregularities caused by the tolerances and deformation of its electrode support frame and other components. In addition, a conductive cushion mat is provided between its cathode and a back board so that tight contact between the ion-exchange membrane and the anode and between the ion-exchange membrane and the cathode can be ensured without damaging the ion-exchange membrane. Patent Document 4 also recommends a rigid structure of the anode in which, mainly to ensure liquid permeability between the anode and the ion-exchange membrane, a catalyst layer should be formed on the surface of a conductive substrate made of an expanded metal of titanium or a mesh of titanium, and the maximum height difference of the surface irregularities of the catalyst layer should be from 5 to 50 μm.

PRIOR ART DOCUMENTS

Patent Documents

Patent Document 1: JP-A-2002-30495
Patent Document 2: JP-B1-2721739
Patent Document 3: JP-A-2001-262387
Patent Document 4: JP-B1-4453973

SUMMARY OF THE INVENTION

Problems to be Solved by the Invention

The methods described in Patent Documents 1 and 2 include subjecting a conductive substrate to sand blasting or acid etching for surface roughening so that a catalyst layer can be deposited with improved adhesion onto the surface of the conductive substrate; and then forming a catalyst layer on the roughened surface of the conductive substrate. Unfortunately, these methods themselves are not enough to produce the effect of reducing electrolytic voltage because the maximum height difference of the surface irregularities of the catalyst layer is not controlled in these methods.

Patent Document 3 proposes a technique for modifying an electrolyzer to reduce electrolytic voltage. However, such a technique has a disadvantage such as complicated structure of the electrolyzer.

According to Patent Document 4, the maximum height difference of the surface irregularities of the catalyst layer is from 5 to 50 μm. However, this catalyst layer has the following problem. When a zero-gap brine electrolyzer having this catalyst layer is operated at low current density, the liquid permeability of the electrolytic electrode is not sufficient. Since the catalyst layer has a relatively small surface area, the electrolytic voltage cannot be satisfactorily reduced.

Means for Solving the Problems

In view of the above problems, it is an object of the invention to provide an anode for use in zero-gap brine electrolyzers, which is designed to have a catalyst layer with a highly-roughened surface and to make it possible to ensure sufficient liquid permeability and further reduce electrolytic voltage. It is another object of the invention to provide a zero-gap brine electrolyzer and a brine electrolysis method therewith, which are designed to make it possible to ensure sufficient liquid permeability and further reduce electrolytic voltage.

As a result of diligent studies for solving the problems, the inventors have completed the invention based on findings that when the surface of the catalyst layer of an anode for use in brine electrolyzers is highly roughened, sufficient liquid permeability can be ensured, and electrolytic voltage can be further reduced.

Specifically, the invention is directed to an anode for use in a zero-gap brine electrolyzer, the anode including: a liquid-permeable conductive substrate; and a catalyst layer that is provided on the conductive substrate and has a maximum height difference of 55 to 70 μm determined as the maximum difference in the height of the surface irregularities of the catalyst layer. In the anode, the conductive substrate is preferably an expanded or punched metal member including a valve metal or an alloy of two or more valve metals, and a total thickness of the conductive substrate and the catalyst layer is preferably from 0.5 to 2.0 mm.

The invention is also directed to a zero-gap brine electrolyzer including: an anode including a liquid-permeable conductive substrate and a catalyst layer that is provided on the conductive substrate and has a maximum height difference of 55 to 70 μm determined as the maximum difference in the height of the surface irregularities of the catalyst layer; a cathode; and an ion-exchange membrane disposed between and in contact with the anode and the cathode.

In a preferred mode of the zero-gap brine electrolyzer, the cathode includes an expanded metal member of nickel with a rigid structure, a fine mesh-shaped cathode with a flexible structure, and a conductive elastic material that has an elastic restoring force and is disposed between the expanded metal member and the fine mesh-shaped cathode, wherein the conductive elastic material is configured to press the fine mesh-shaped cathode against the ion-exchange membrane. The conductive elastic material is preferably in the form of a cushion mat or a spring.

The invention is also directed to a method for zero-gap brine electrolysis, the method including electrolyzing a sodium chloride-containing liquid with the zero-gap brine electrolyzer having any of the above features.

Effect of the Invention

According to the invention, liquid permeability can be ensured without damaging an ion-exchange membrane particularly in a zero-gap brine electrolyzer even when the pressure at which the ion-exchange membrane is pressed against the anode increases as the cathode comes into tight contact with the ion-exchange membrane. Further, the catalyst layer whose surface irregularities have a maximum height difference of 55 to 70 μm can have an increased surface area. Thus, a zero-gap brine electrolyzer and an electrolytic method are provided which make it possible to reduce electrolytic voltage.

MODE FOR CARRYING OUT THE INVENTION

Figure 1:
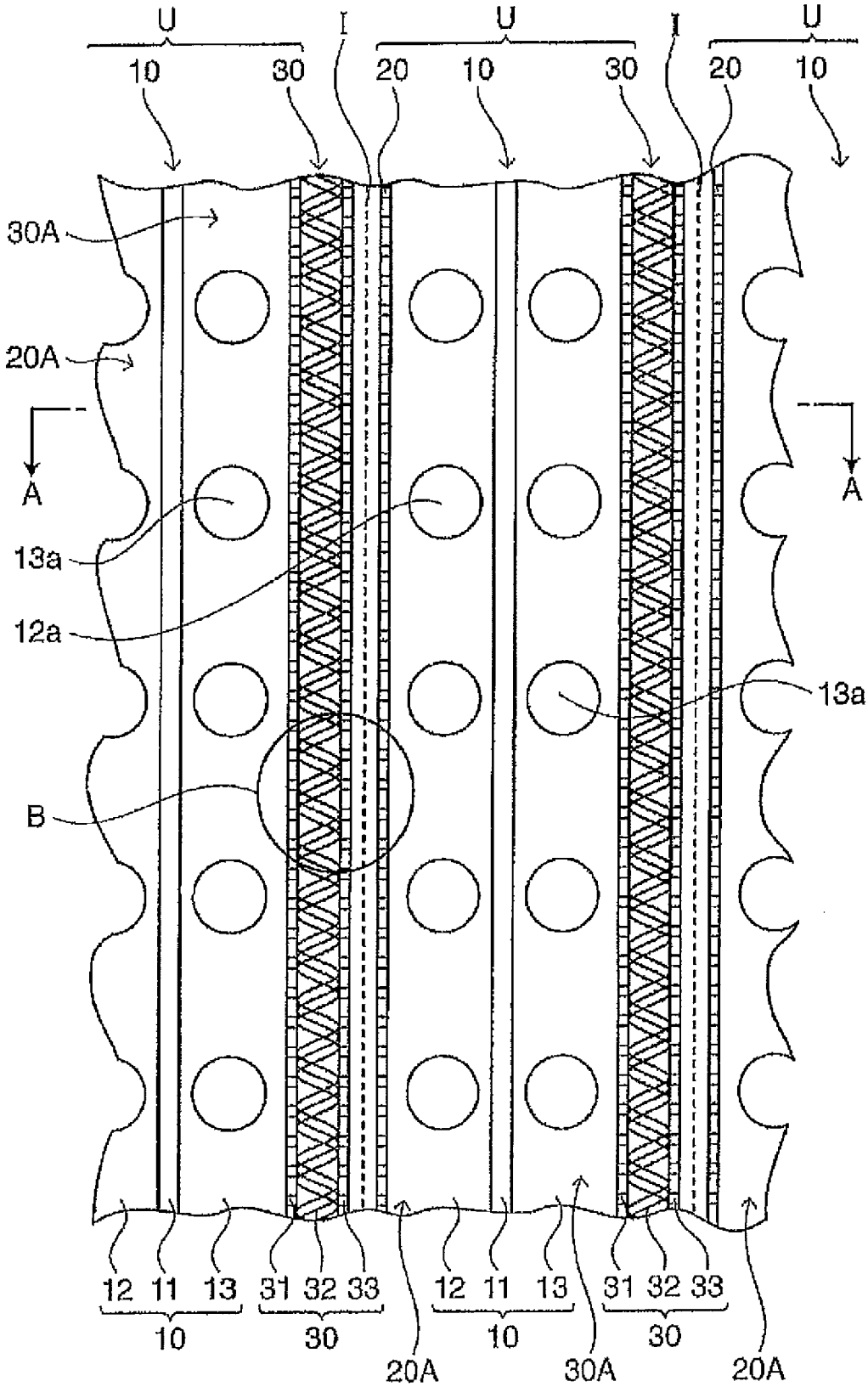
FIG. 1 is a vertical sectional side view schematically showing the structure of electrode units used to forma zero-gap brine electrolyzer according to the invention.

Hereinafter, embodiments of the invention will be described in detail with reference to the drawings. It will be understood that the embodiments described below are not intended to limit the invention.

The anode of the invention for use in a zero-gap brine electrolyzer includes a liquid-permeable conductive substrate and a catalyst layer that is provided on the conductive substrate and has a maximum height difference of 55 to 70 μm determined as the maximum difference in the height of the surface irregularities of the catalyst layer. The anode with such a structure can be obtained by, for example, the following manufacturing method. Specifically, a manufacturing method according to the embodiment includes step A of subjecting a conductive substrate to sand blasting and/or step B of surface-treating the conductive substrate by dipping the conductive substrate into an acid, and step C of forming a catalyst layer on the treated surface of the conductive substrate.

The method according to the embodiment for manufacturing an electrode for use in a brine electrolyzer includes first providing a liquid-permeable conductive substrate. The conductive substrate may be made of a valve metal such as titanium, tantalum, zirconium, or niobium or an alloy of two or more valve metals. The conductive substrate may be in the form of an expanded metal member or a punched metal member.

Step A includes subjecting the surface of the conductive substrate to sand blasting, which is expected to produce an anchor effect for supporting the catalyst layer. The sand blasting is a surface treatment method that includes blasting the surface of a material with a high-pressure gas containing sand-like particles. Any known method may be used for the sand blasting. In the sand blasting, for example, the type of the abrasive used and the blasting time may be controlled so that the surface roughness of the conductive substrate can be controlled. Sand-like particles may include alumina, glass, iron, etc. If necessary, the sand blasting may be followed by degreasing or the like.

Step B includes dipping the conductive substrate into an acid to surface-treat the substrate. The acid is typically, but not limited to, sulfuric acid, nitric acid, hydrochloric acid, oxalic acid, hydrofluoric acid, or the like.

As a result of step A and/or step B, the electrode for electrolysis obtained by the manufacturing method has a highly-roughened catalyst layer surface, whose maximum height difference is as large as 55 to 70 μm with respect to the surface irregularities, so that the electrode can ensure sufficient liquid permeability and have an increased surface area, which allows a reduction in electrolytic voltage.

Step C includes forming, after step A and/or step B, a catalyst layer on the surface of the conductive substrate. The catalyst layer maybe made of any material capable of activating electrolysis. Step C may include preparing a solution of a metal salt of an electrode active material such as a mixed oxide of a platinum group metal such as iridium, ruthenium, or platinum and a valve metal, specifically, an iridium-tantalum mixed oxide, an iridium-ruthenium-titanium mixed oxide, or an iridium-ruthenium-platinum mixed oxide, applying the solution to the surface of the conductive substrate, drying the coated substrate, and then baking the coated substrate at a certain heating temperature. In this way, the electrode according to the embodiment for brine electrolysis is obtained.

The above embodiment shows a case where after sand blasting and/or dipping into an acid, the catalyst layer is formed on the surface of the conductive substrate. It should be noted that the embodiment is non-limiting and the electrode according to the invention may have an additional layer or layers in addition to the conductive substrate and the catalyst layer. For example, after the sand blasting and before the formation of the catalyst layer, an underlying layer may be formed on the surface of the conductive substrate, and then the catalyst layer may be formed on the underlying layer. The underlying layer may be a tantalum oxide-containing layer, a sputtered tantalum layer, or the like.

The zero-gap brine electrolyzer of the invention includes the anode obtained as described above, a cathode, and an ion-exchange membrane disposed between and in contact with the anode and the cathode. The zero-gap brine electrolyzer may be a bipolar brine electrolyzer or a monopolar brine electrolyzer.

Figure 2:
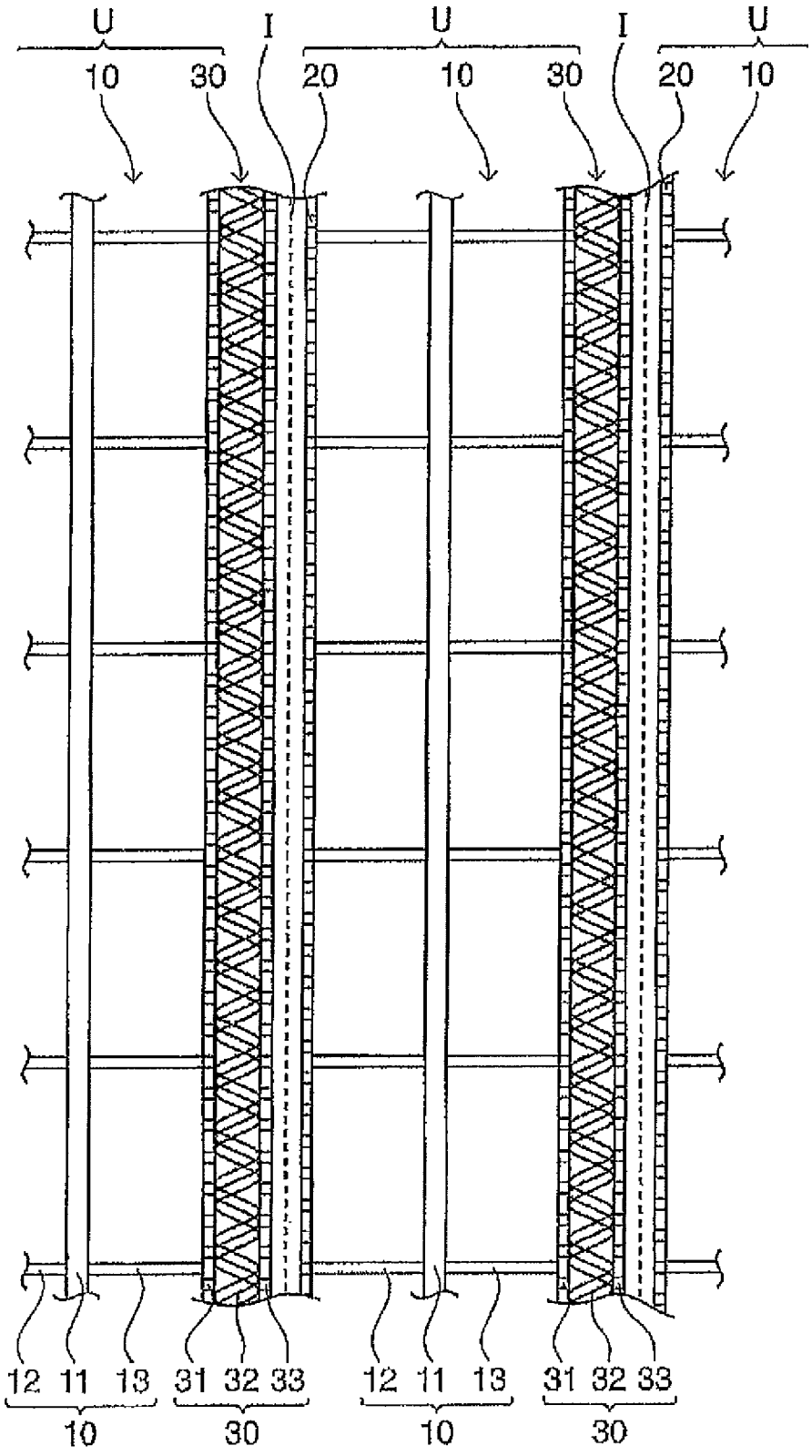
FIG. 2 is a cross-sectional view taken along line A-A in FIG. 1.

The zero-gap brine electrolyzer of the invention may have an electrode unit U for a zero-gap brine electrolyzer as shown in FIGS. 1 and 2. The electrode unit U can form an anode chamber 20A and a cathode chamber 30A, which have an anode 20 and a cathode 30, respectively. This electrode unit is used to form a zero-gap brine electrolyzer for ion exchange membrane process. In the illustrated example, a certain number of electrode units U are arranged in a tandem manner with the same polarity, and an ion-exchange membrane I is disposed between each set of adjacent units U-U, so that a bipolar brine electrolyzer is formed. On the other hand, a monopolar brine electrolyzer may be as follows. Either an anode 20 or a cathode 30 is formed in a single electrode unit U. The respective electrode units U are alternately arranged with an ion-exchange membrane I interposed therebetween to forma monopolar brine electrolyzer.

As shown in FIGS. 1 and 2, each individual electrode unit U includes an electrode support frame 10 having a vertical partition 11 perpendicular to the tandem direction. The electrode support frame 10 is provided to support an anode 20 with a rigid structure on one side of the partition 11 and to support a cathode structure 30 on the other side.

To support the anode 20, a plurality of vertical ribs 12 are arranged at certain horizontal intervals and attached to one surface of the vertical partition 11. The anode 20 is attached to the front end of these ribs 12. The anode chamber 20A is formed between the anode 20 and the partition 11 behind the anode 20. Each vertical rib 12 has a plurality of through holes 12*a* so that an electrolytic solution can freely flow in the horizontal direction in the anode chamber 20A.

Similarly, a plurality of vertical ribs 13 are arranged at certain horizontal intervals and attached to the other surface of the vertical partition 11 of the electrode support frame 10, and the cathode structure 30 is attached to the front end of these ribs 13. The cathode chamber 30A is formed between the cathode structure 30 and the partition 11 behind the cathode structure 30. Each vertical rib 13 has a plurality of through holes 13*a* so that an electrolytic solution can freely flow in the horizontal direction in the cathode chamber 30A.

Figure 3:
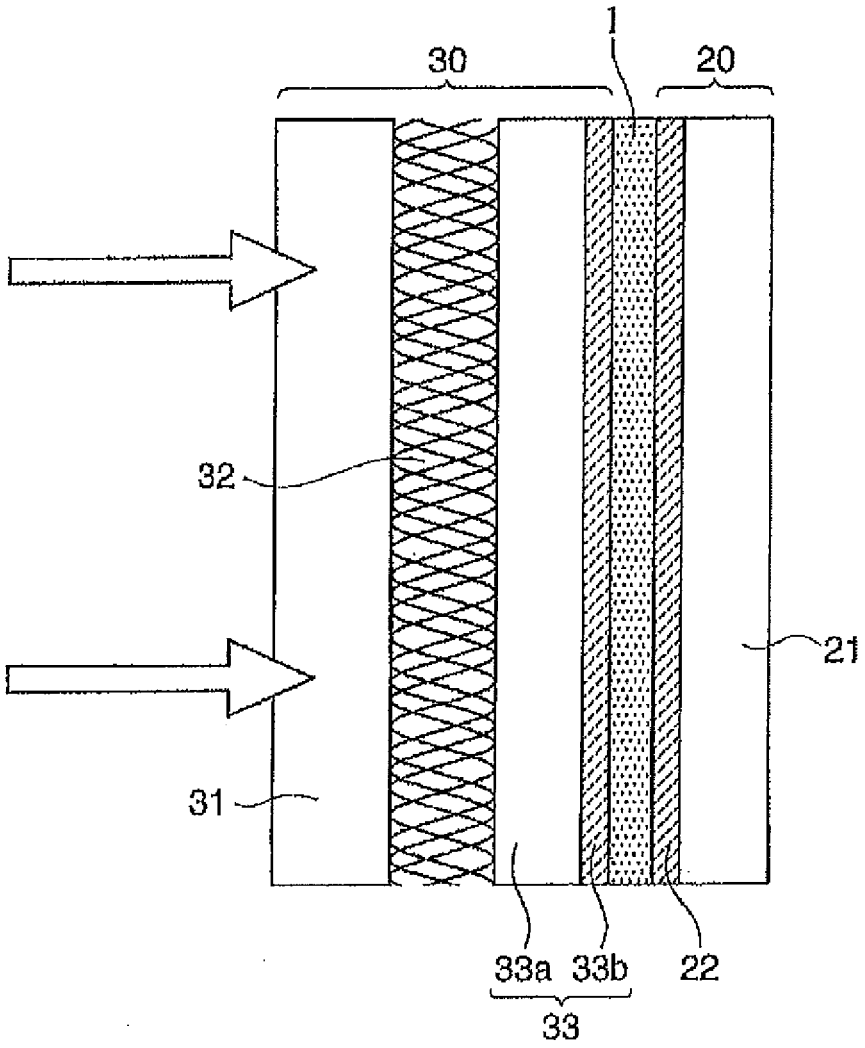
FIG. 3 is a principal part sectional view showing, in an enlarged manner, the detailed structure of part B in FIG. 1.

FIG. 3 shows a plate-shaped conductive substrate 21. The conductive substrate 21 has a plurality of openings so as to be liquid-permeable. Specifically, the anode 20 with a rigid structure includes a liquid-permeable, plate-shaped, highly-rigid, conductive substrate 21 and an active catalyst layer 22 formed on the front-side surface of the conductive substrate 21. The conductive substrate 21 includes, for example, an expanded or punched metal member of titanium with an opening area ratio of 25 to 75%. The opening area ratio of the conductive substrate is preferably from 30 to 60%.

The thickness of the anode 20 with a rigid structure including the catalyst layer is preferably from 0.5 to 2.0 mm. The conductive substrate 21 preferably has a thickness of 0.5 to 2.0 mm. The catalyst layer 22 of the anode for brine electrolysis preferably has a thickness of 1 to 5 μm. The catalyst layer preferably has an average surface roughness of 3 μm to 30 μm. The catalyst layer has a maximum height difference of 55 to 70 μm determined as the maximum difference in the height of the surface irregularities of the catalyst layer.

The maximum height difference of the surface irregularities of the catalyst layer is in the range of 55 to 70 μm, preferably in the range of 60 to 70 μm, more preferably in the range of 65 to 70 μm. If the maximum height difference of the surface irregularities of the catalyst layer is less than 55 μm, the catalyst layer cannot provide sufficiently reduced electrolyzer voltage due to a relatively small surface area and insufficient liquid-permeability. On the other hand, if the maximum height difference is more than 70 μm, the ion-exchange membrane can be easily damaged when the pressure at which the ion-exchange membrane is pressed against the anode increases as the cathode comes into tight contact with the ion-exchanged membrane. In addition, if it is more than 70 μm, electrolyte flow uniformity will be difficult to maintain, which can make it impossible to sufficiently reduce the electrolyzer voltage.

The catalyst layer also preferably has an average surface roughness in the range of 3 to 30 μm, more preferably in the range of 5 to 25 μm, even more preferably in the range of 6 to 20 μm. If the catalyst layer has an average surface roughness of less than 3 μm, it would have a relatively small surface area and insufficient liquid permeability. On the other hand, if the average surface roughness exceeds 30 μm, the ion-exchange membrane can be damaged when the pressure at which the ion-exchange membrane is pressed against the anode increases as the cathode comes into tight contact with the ion-exchanged membrane.

The operating current density of the zero-gap brine electrolyzer is preferably from 1 to 5 $kA/m^2$, more preferably from 1 to 4 $kA/m^2$. If the current density exceeds 5 $kA/m^2$, the pressure at which the ion-exchange membrane is pressed against the anode can increase as the cathode comes into tight contact with the ion-exchange membrane, so that the ion-exchange membrane can be easily damaged and electrolyte flow uniformity can be difficult to maintain, which can make it impossible to sufficiently reduce the electrolyzer voltage.

The average surface roughness of the catalyst layer and the maximum height difference of the surface irregularities of the catalyst layer were determined using Surface Roughness Tester SJ-301 (manufactured by Mitutoyo Corporation). First, calibration was performed using roughness standard specimen according to JIS B 0601 (1994). Subsequently, the surface to be measured was horizontally placed, and the movable detection part was placed on the object to be measured. The fine irregularities of the object surface were traced by the stylus of the detector. The vertical and horizontal movements of the stylus were used to determine the average surface roughness of the catalyst layer and the maximum height difference of the surface irregularities of the catalyst layer.

The active cathode 33 of the cathode structure 30 is also preferably an active electrode including a liquid-permeable conductive substrate 33*a* and an active catalyst layer 33*b* formed on the surface of the substrate 33*a*, which can reduce the electrolytic voltage. In the cathode, the conductive substrate 33*a* is preferably an expanded metal member of nickel, a punched metal member of nickel, or a fine mesh of nickel in view of corrosion resistance and the like. A fine mesh of nickel, which is a flexible structure, is particularly preferred in view of cost effectiveness, reduction of damage to the ion-exchange membrane, and other purposes. As in the case of the anode 20, the conductive substrate 33*a* preferably has an opening area ratio of 25 to 75% in view of mechanical strength, liquid permeability, and other properties. The thickness of the cathode 33 including the catalyst layer 33*b* is preferably from 0.7 to 2.0 mm in order to achieve both cost effectiveness and high mechanical strength.

The cathode structure 30 has a conductive elastic material 32. The conductive elastic material 32 is preferably in the form of a spring or a conductive cushion mat, which is formed by tangling conductive metal fine wires into a mat. This is because they are highly flexible and cost-effective. Like the cathode, the conductive elastic material 32 is preferably made of nickel. In the conductive cushion mat, the wire diameter is generally 0.05 to 0.3 mm, preferably 0.07 to 0.2 mm, more preferably 0.1 to 0.15 mm.

The conductive cushion mat preferably has a bulk density of 0.2 to 2 kg/m$^2$. The conductive cushion mat preferably has a thickness of 5 to 10 mm when no load is applied thereto, and preferably has a thickness of 4 to 8 mm when it is in tight contact with the ion-exchange membrane after the electrode units are joined together. This is because unless a certain level of mechanical strength is achieved, a pressure sufficient enough to push the ion-exchange membrane from the cathode to the anode cannot be ensured.

The conductive elastic material 32 in the form of a spring is preferably such that the spring height is 1.5 mm to 6 mm before compression and then even when the spring height is uniformly compressed by 1.0 to 2.5 mm, at least the distance by which the spring is compressed can be restored. The elastic restoring force of the conductive elastic material 32 is preferably from 7 to 15 kPa.

Figure 4:
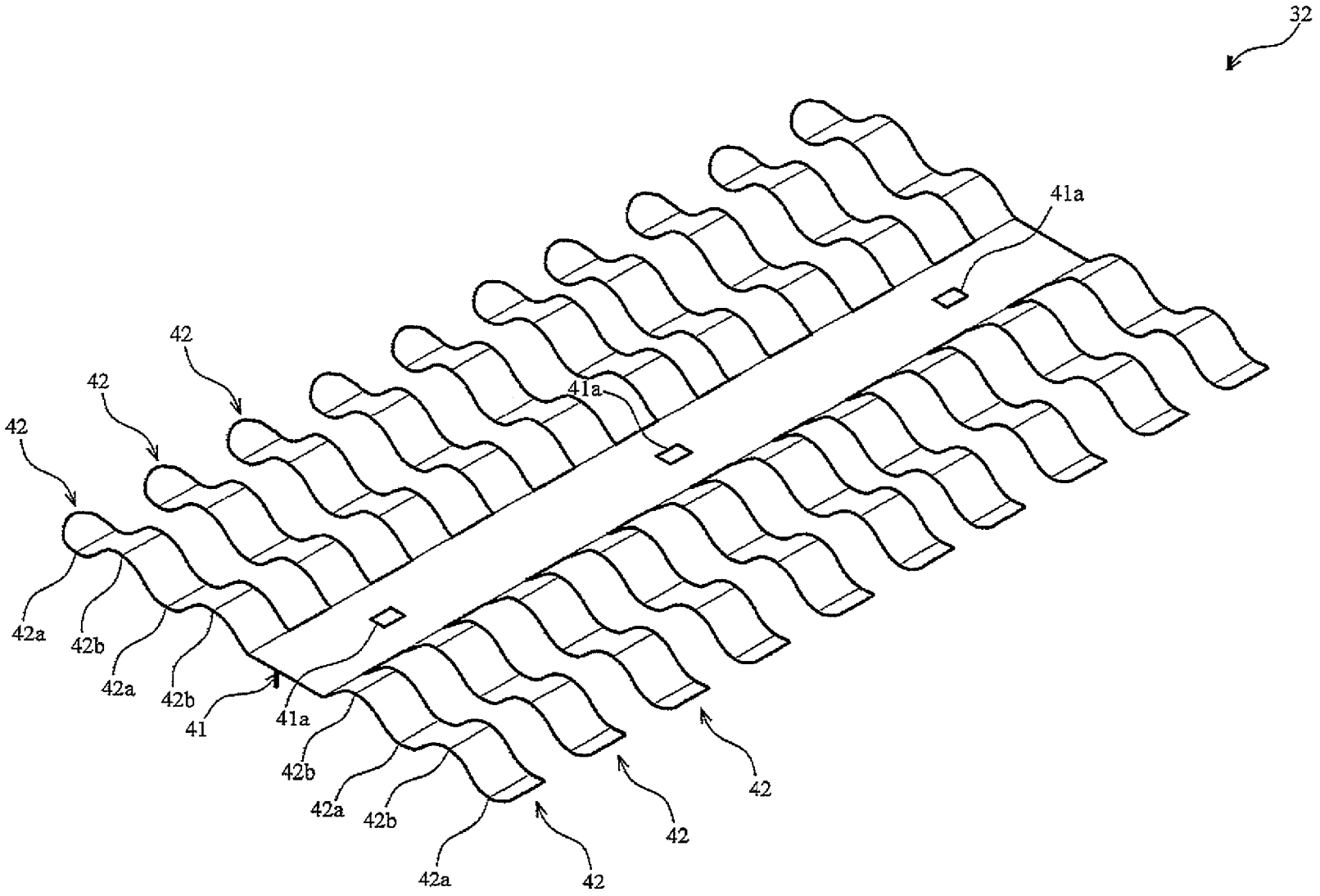
FIG. 4 is a perspective view showing the structure of a conductive elastic material used for a zero-gap brine electrolyzer according to the invention.

As shown in FIG. 4, for example, the conductive elastic material 32 in the form of a spring may include a flat stationary part 41 extending in the longitudinal direction and elastic parts 42 that extend in the transverse direction from the stationary part 41 and are formed in a concave convex shape. The stationary part 41 of the conductive elastic material 32 has holes 41*a*, through which fixing members can be provided to attach the conductive elastic material 32 to a back board 31. Each elastic part 42 in a concave convex shape is in a corrugated shape or shaped so as to have at least one side bent at an angle of at least 1°. In the illustrated example, the elastic part 42 is structured to have a base support part 42*a* which is formed to be supported by the back board 31, and a cathode support part 42*b* which is formed to support the active cathode 33. In FIG. 4, the elastic parts 42 are provided at symmetrical positions on both sides of the stationary part 41. Alternatively, the elastic parts 42 may be provided at asymmetrical positions (e.g., alternate positions) on both sides.

The conductive elastic material 32 in the form of a spring is, for example, such that its base material has a thickness of 0.02 to 0.3 mm, the longitudinally flat stationary part 41 has a width of 5 to 30 mm, the concave convex shape of the elastic part 42 has a period of 10 mm or more, and the space formed by the concave convex shape has a width of 2 to 20 mm. The conductive elastic material 32 in such a form is preferably such that the its base material has a thickness of 0.20 mm, the stationary part 41 has a width of 10 mm, the concave convex shape of the elastic part 42 has a period of 10 mm, and the space has a width of 8 mm.

In the electrode unit U, the cathode structure 30 is a three-layer structure including the back board 31, the conductive elastic material 32, and the active cathode 33 with a flexible structure. The back board 31 is directly attached to the vertical ribs 13 of the electrode support frame 10, and the active cathode 33 is placed on the front side of the back board 31 with the elastic material 32 interposed therebetween. The back board 31 includes an expanded metal member of nickel, which is a rigid structure. The conductive cushion mat or spring-shaped conductive elastic material 32 contributes to the elastic contact of the active cathode 33 of a flexible structure with the ion-exchange membrane I disposed between the cathode 33 and the electrode unit U on the front side.

The ion-exchange membrane I may be of any type used in brine electrolyzers. For example, a chlorine-resistant perfluorosulfonic acid resin or perfluorocarboxylic acid resin membrane may be used as the ion-exchange membrane I.

The method of the invention for zero-gap brine electrolysis includes electrolyzing a sodium chloride-containing liquid with the zero-gap brine electrolyzer described above. The electrolytic conditions such as electrolyte, liquid temperature, current density, and electrolyzer voltage may be the same as those used in conventional electrolytic methods using zero-gap brine electrolyzers.

EXAMPLES

Next, preferred examples of the invention will be described in detail by way of illustration and compared with comparative examples so that the advantageous effects of the invention will be apparent. It will be understood that unless otherwise stated, the materials, the contents, and other conditions described in the examples are not intended to limit the gist of the invention.

Example 1

The anode is a liquid-permeable electrode with a rigid structure having, as a conductive substrate, an expanded metal member of titanium with an opening area ratio of 50%. The surface of the substrate was subjected to sand blasting with #36 alumina. A butanol solution containing ruthenium chloride, iridium chloride, butyl titanate, and hydrochloric acid was applied to the resulting roughened surface of the conductive substrate. The substrate coated with the solution was subjected to drying at 100° C. for 10 minutes and then baked at 500° C. for 10 minutes. After cycles of the application-drying-baking process, an about 2-μm-thick active catalyst layer was formed on the surface of the substrate, so that the anode was obtained. The maximum height difference of the surface irregularities of the catalyst layer formed was determined using Surface Roughness Tester SJ-301 (manufactured by Mitutoyo Corporation). As a result, the determined maximum height difference was 65 μm, which was the same as the surface roughness of the substrate after the surface roughening. The catalyst layer also had an average surface roughness of 11 μm.

On the other hand, the cathode includes an expanded metal member of nickel with an opening area ratio of 50% as a conductive substrate that forms a rigid structure electrode; a conductive elastic material in the form of a spring; and an active cathode supported on the front side of the rigid structure electrode with the elastic material interposed therebetween.

The active cathode is an electrode with a flexible structure having, as a conductive substrate, a micro-mesh of nickel with an opening area ratio of 50%. The surface of this conductive substrate was subjected to sand blasting with #180 alumina and then etched in a 10% by weight hydrochloric acid solution at room temperature for 60 minutes. A nitric acid solution containing dinitrodiamine platinum was applied to the resulting roughened surface of the conductive substrate. The substrate coated with the solution was subjected to drying at 100° C. for 10 minutes and then baked at 500° C. for 10 minutes. After cycles of the application-drying-baking process, an about 2-μm-thick active catalyst layer was formed on the surface of the substrate, so that the active cathode was completed.

An ion-exchange membrane FLEMION F-8020 SP (manufactured by ASAHI GLASS CO., LTD.) was sandwiched between the anode and the cathode structure. A zero-gap brine electrolyzer was built by arranging the electrode units in a tandem manner while bringing the cathode structure into tight contact with the ion-exchange membrane.

Figure 5:
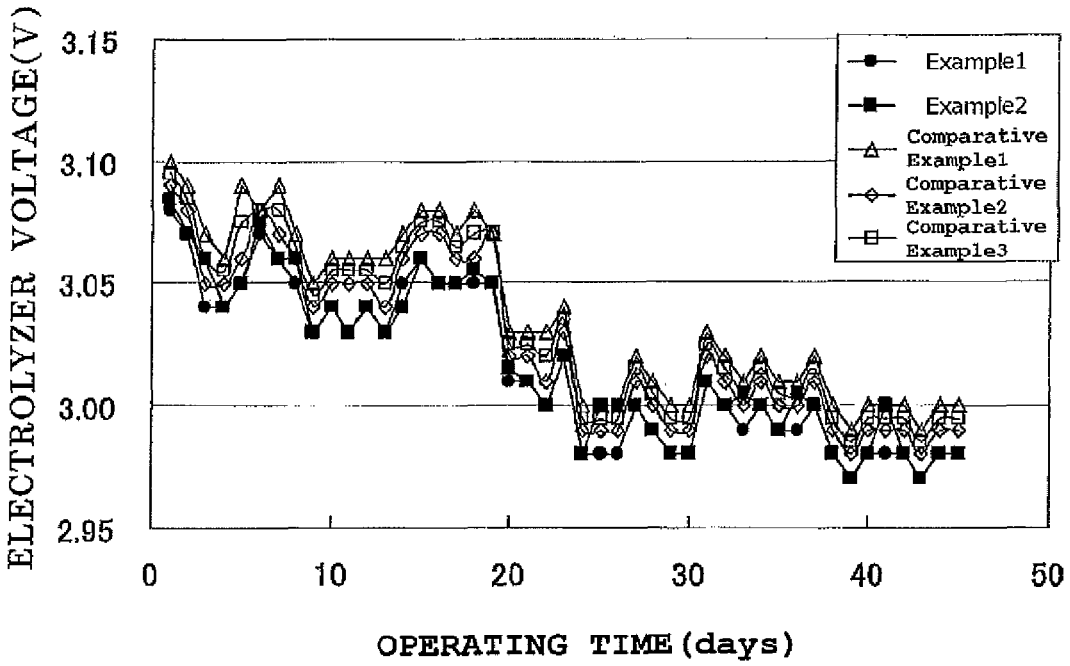
FIG. 5 is a graph showing how the electrolyzer voltage changes over time in Examples and Comparative Examples.

Electrolysis operation was performed under the conditions of a liquid temperature of 80° C. and a current density of 4 $kA/m^2$ using the resulting zero-gap brine electrolyzer, in which 250 g/L brine was supplied as an electrolyte to the anode chamber, and a 32% sodium hydroxide solution was supplied to the cathode chamber. The electrolyzer voltage was 2.98 V. Substantially no increase in the voltage was observed even after 45 days from the start of the test. FIG. 5 shows how the electrolyzer voltage changed over time from the start of the test.

Example 2

An anode and a cathode were prepared under the same conditions as those in Example 1, and a zero-gap electrolyzer was built as in Example 1, except that the conductive elastic material was in the form of a mat of woven nickel mesh, which was interposed between the rigid structure electrode of the conductive substrate of expanded nickel metal and the active cathode supported on the front side of the rigid structure electrode. FIG. 5 shows how the electrolyzer voltage changed over time from the start of the test. The electrolyzer voltage was 2.98 V, substantially the same as that in Example 1, and substantially no increase in the voltage was observed even after 45 days from the start of the test.

Comparative Example 1

In the process of Example 1, the expanded metal member of titanium for use as the conductive substrate for the anode was roughened so as to have a surface roughness of 20 μm. The maximum height difference of the surface irregularities of the catalyst layer formed through the application of the acidic solution was determined using Surface Roughness Tester SJ-301 (manufactured by Mitutoyo Corporation). As a result, the determined maximum height difference was 20 μm, which was the same as the surface roughness of the substrate after the surface roughening. The catalyst layer also had an average surface roughness of 6 μm. FIG. 5 shows how the electrolyzer voltage changed over time from the start of the test. The electrolyzer voltage was 20 mV higher than that in Example 1.

Comparative Example 2

In the process of Example 1, the expanded metal member of titanium for use as the conductive substrate for the anode was roughened so as to have a surface roughness of 50 μm. The maximum height difference of the surface irregularities of the catalyst layer formed through the application of the acidic solution was 50 μm, which was the same as the surface roughness of the substrate after the surface roughening. The catalyst layer also had an average surface roughness of 9 μm. FIG. 5 shows how the electrolyzer voltage changed over time from the start of the test. The electrolyzer voltage was 10 mV higher than that in Example 1.

Comparative Example 3

In the process of Example 1, the expanded metal member of titanium for use as the conductive substrate for the anode was roughened so as to have a surface roughness of 80 μm. The maximum height difference of the surface irregularities of the catalyst layer formed through the application of the acidic solution was 80 μm, which was the same as the surface roughness of the substrate after the surface roughening. The catalyst layer also had an average surface roughness of 15 μm. FIG. 5 shows how the electrolyzer voltage changed over time from the start of the test. The electrolyzer voltage was 15 mV higher than that in Example 1.

DESCRIPTION OF REFERENCE SIGNS

In the drawings, reference sign U represents an electrode unit, I an ion-exchange membrane, 10 an electrode support frame, 11 a partition, 12 and 13 a vertical rib, 12*a* and 13*a* a through hole, 20 an anode, 20A an anode chamber, 21 a conductive substrate, 22 an anode catalyst layer, 30 a cathode structure, 30A a cathode chamber, 31 a back board, 32 a conductive elastic material, 33 an active cathode, 33*a* a conductive substrate, and 33*b* a cathode catalyst layer.

What is claimed is:

1. An anode for use in a zero-gap brine electrolyzer, comprising:

a liquid-permeable conductive substrate; and a catalyst layer that is provided on the conductive substrate and has 55 to 70 μm of maximum difference in height of surface irregularities of the catalyst layer, wherein the catalyst layer has a thickness of 1 to 5 μm and an average surface roughness of 3 to 30 μm.

2. The anode according to claim 1 for use in a zero-gap brine electrolyzer, wherein the conductive substrate is an expanded or punched metal member comprising a valve metal or an alloy of two or more valve metals, and a total thickness of the conductive substrate and the catalyst layer is from 0.5 to 2.0 mm.

3. A zero-gap brine electrolyzer, comprising:

an anode comprising a liquid-permeable conductive substrate and a catalyst layer that is provided on the conductive substrate and has 55 to 70 μm of maximum difference in height of surface irregularities of the catalyst layer;

a cathode; and an ion-exchange membrane disposed between and in contact with the anode and the cathode, wherein the catalyst layer has a thickness of 1 to 5 m and an average surface roughness of 3 to 30 μm.

4. The zero-gap brine electrolyzer according to claim 3, wherein the conductive substrate is an expanded or punched metal member comprising a valve metal or an alloy of two or more valve metals, and the total thickness of the conductive substrate and the catalyst layer is from 0.5 to 2.0 mm.

5. The zero-gap brine electrolyzer according to claim 3, wherein the cathode comprises an expanded metal member of nickel with a rigid structure, a fine mesh-shaped cathode member with a flexible structure, and a conductive elastic material that has an elastic restoring force and is disposed between the expanded metal member and the fine mesh-shaped cathode member, and wherein the conductive elastic material is configured to press the fine mesh-shaped cathode member against the ion-exchange membrane.

6. The zero-gap brine electrolyzer according to claim 5, wherein the conductive elastic material is in the form of a cushion mat or a spring.

7. A method for zero-gap brine electrolysis, the method comprising electrolyzing a sodium chloride-containing liquid with the zero-gap brine electrolyzer according to claim 3.

* * * * *